United States Patent [19]

Karns

[11] Patent Number: 4,743,133

[45] Date of Patent: May 10, 1988

[54] INKED RIBBON CARTRIDGE

[75] Inventor: Ward L. Karns, Waynesboro, Va.

[73] Assignee: General Electric Company, Lynchburg, Va.

[21] Appl. No.: 884,918

[22] Filed: Jul. 14, 1986

Related U.S. Application Data

[62] Division of Ser. No. 429,002, Sep. 30, 1982, Pat. No. 4,630,948.

[51] Int. Cl.[4] ..... B41J 32/02

[52] U.S. Cl. ..... 400/208.1; 400/196.1

[58] Field of Search ..... 400/196, 196.1, 208, 400/208.1, 248; 403/106, 109, 104

[56] References Cited

U.S. PATENT DOCUMENTS

| | | | |
|---|---|---|---|
| 2,685,357 | 8/1954 | Koreska | 400/196.1 |
| 3,356,202 | 12/1967 | Goff, Jr. | 400/208 |
| 3,383,694 | 5/1968 | Strohmeyer, Jr. | 403/109 |
| 3,567,261 | 3/1971 | Akezinski | 403/106 |
| 3,593,949 | 7/1971 | Fliege | 403/104 |
| 3,621,968 | 11/1971 | Kondur, Jr. | 400/196.1 |
| 3,643,777 | 2/1972 | Anderson et al. | 400/208 |
| 3,701,495 | 10/1972 | Holliday | 242/197 |
| 3,726,381 | 4/1973 | Murphy | 400/196.1 |
| 3,758,012 | 9/1973 | Bonner et al. | 400/195 |
| 3,973,707 | 8/1976 | Pratt, Jr. et al. | 400/196.1 |
| 3,989,132 | 11/1976 | Carson, Jr. | 400/196.1 |
| 4,043,277 | 8/1977 | Wallace | 403/106 |
| 4,213,716 | 7/1980 | Carson, Jr. | 400/196.1 |
| 4,257,282 | 3/1981 | Wilczewski et al. | 400/196.1 |
| 4,343,556 | 8/1982 | Kobayashi | 400/196.1 |
| 4,352,577 | 10/1982 | Chida et al. | 400/196.1 |
| 4,383,774 | 5/1983 | Yonkers | 400/196.1 |
| 4,437,778 | 3/1984 | Myashika et al. | 400/248 |
| 4,600,325 | 7/1986 | Okamoto et al. | 400/208 |

FOREIGN PATENT DOCUMENTS

| | | | |
|---|---|---|---|
| 19649 | 12/1980 | European Pat. Off. | 400/208.1 |
| 40312 | 11/1981 | European Pat. Off. | 400/196.1 |
| 2358180 | 5/1975 | Fed. Rep. of Germany | 400/208 |
| 2718688 | 10/1977 | Fed. Rep. of Germany | 400/196 |
| 2637138 | 2/1978 | Fed. Rep. of Germany | 400/196.1 |
| 3138110 | 4/1983 | Fed. Rep. of Germany | 400/196 |

*Primary Examiner*—William Pieprz

*Attorney, Agent, or Firm*—Nixon & Venderhye

[57] ABSTRACT

The inked ribbon cartridge comprises an endless ribbon, an elongated housing for the ribbon, a first laterally extending finger at one end of the housing, a longitudinally slidable arm at the other end of the housing carrying a second finger disposed generally parallel to the first finger. A drive wheel is located behind the ribbon and is rotatable for withdrawing ribbon from the front section and is operative to create folds in the used ribbon and to stuff the folds of ribbon between the drive wheel and the ribbon. A fixedly mounted stripper ring encircles the drive wheel and carries a stripper foot to strip the ribbon from the wheel. At the exit port are three aligned support members with the middle support member being over center with respect to the other two. A leaf spring member is located in contact with all three support members. The ribbon passes between one of the support members and the spring. The end portion of the spring member has top and bottom tabs with a height exceeding the height of the interior of the housing.

20 Claims, 4 Drawing Sheets

INKED RIBBON CARTRIDGE

This is a division of application Ser. No. 429,002 filed Sept. 30, 1982, now issued U.S. Pat. No. 4,630,948.

BACKGROUND OF THE INVENTION

This invention relates to inked ribbon cartridges for mounting in a printer, typewriter of similar machine. The cartridge stores an inked ribbon, delivers it for printing purposes and stores the used ribbon.

An inked ribbon cartridge has a housing for the bulk storage of ribbon. Ribbon is threaded through the printer mechanism where it is used in printing. The used ribbon is drawn back into the housing where it is again stored. The used ribbon may be reused as is, or it may be reinked before subsequent use, or after all of the ribbon has been used once only, the cartridge can be discarded. The stored ribbon is arranged either in folded endless form or in roll form. Cartridges of this type are generally known. For example, see U.S. Pat. No. 3,989,132 assigned to the assignee of the present application.

One disadvantage of many currently available cartridges is that it takes an undesirable amount of time and effort to thread the ribbon through various rollers and the like in the printer. Displacing the ribbon from the housing by routing the ribbon through laterally extending fingers helps. Oftentimes the cartridge is designed to be stationary and the print head to travel back and forth, striking the ribbon and printing characters on the print medium, and the print head travel matches the distance between the fingers. This is usually done to conserve lateral space in the printer. When the distance between the fingers is fixed, the cartridge can be used in only that printer having a corresponding or smaller print head travel length.

The used ribbon is in contact with a drive wheel located in a space in the housing unoccupied by the ribbon. As the wheel rotates, it withdraws ribbon from the supply thereof to be struck by the print head and at the same time draws ribbon already struck by the print head, into the cartridge. Means associated with the drive wheel strip the ribbon therefrom and deposit it in the housing. Sometimes the ribbon is not effectively stripped from the wheel or actually is drawn into the stripper mechanism itself, thereby creating a ribbon jam. Ribbon jams also tend to occur at the means to place the ribbon in tension.

SUMMARY OF THE INVENTION

It is therefore an important object of the present invention to provide an inked ribbon cartridge for use in printers having different travel lengths of the print head without the printers being impractically wide.

Another object is to provide an inked ribbon cartridge which requires a minimum amount of threading of the exposed ribbon when a new cartridge is installed.

Another object is to provide an inked ribbon cartridge in which the used ribbon has a reduced likelihood of being jammed for failure to be taken off the drive wheel or to be caught in the stripper mechanism.

Another object is to provide an inked ribbon cartridge in which the ribbon has a reduced tendency to become jammed in the cartridge.

Another object is to provide an inked ribbon cartridge in which the ribbon can be stored in folded endless form or in roll form.

Another object is to insure that the ribbon is under some tension as it is being presented to the print head by use of a leaf spring and at the same time minimizing the changes of the ribbon being caught by the edges of the leaf spring.

In summary there is provided an inked ribbon cartridge for a printing device comprising a ribbon an elongated housing for storing the ribbon, the housing having a port at one end thereof through which the ribbon exits from the housing, a first finger extending laterally from the other end of the housing, the first finger being hollow and communicating with the interior of the housing to loosely receive the ribbon, an arm extending longitudinally from the one end of the housing and being longitudinally slidably movable thereon, the arm carrying a laterally extending second finger disposed generally parallel to the first finger, the second finger being hollow and loosely receiving the ribbon extending from the port, the ribbon being used in the region between the fingers.

In another aspect of the invention, there is provided an inked ribbon cartridge for a printing device comprising a ribbon, an elongated housing having first and second longitudinally adjacent sections, the housing having a ribbon inlet port at one end thereof in communication with the second section and having a ribbon outlet port at the other end of the housing in communication with the first section, the ribbon being stored in the first section and exiting the housing through the ribbon outlet port and entering the housing through the ribbon inlet port, a drive wheel in the second section and having an annular tread surface, means for holding the ribbon in operative contact with the annular tread surface, the drive wheel being rotatable for withdrawing stored ribbon from the first section and being operative to alternately create upper folds in the ribbon and to stuff the folds of used ribbon between the drive wheel and the stored ribbon, a stripper ring fixedly mounted in the first section and encircling the drive wheel and being slightly spaced therefrom to enable the drive wheel to rotate unimpeded by the ring, the diameter of the outer surface of the ring being no greater than the diameter of the annular tread surface so as not to interfere with movement of the ribbon, and a stripper foot integral with the ring and extending outwardly therefrom and toward the first section, the stripper foot being operative to limit the extent of movement of each fold so that the drive wheel can then create the next fold.

In yet another aspect of the invention, there is provided an inked ribbon cartridge for a printing device comprising a ribbon, an elongated housing having an interior cavity defined by top and bottom surfaces for storing the ribbon, the housing having a port at one end thereof through which the ribbon exits, a first end support member in the housing located adjacent to the opening and having a support surface, a second end support member in the housing and having a support surface, a middle support member in the housing disposed between the end support members and having a support surface, a strip-shaped spring member in engagement with all of the support surfaces, the support surface of the middle support member being over center with respect to the support surfaces of the end support members so that the spring member is biased tightly against the support surface of the first end support member, the ribbon being located between the spring member and the support surface of the first end support member, the end portion of the spring member in contact with the first end support member having top and bottom tabs with a total height greater than the distance between the top and bottom surfaces, the top and bottom surfaces respectively having openings therein respectively receiving the top and bottom tabs.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings preferred embodiments thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
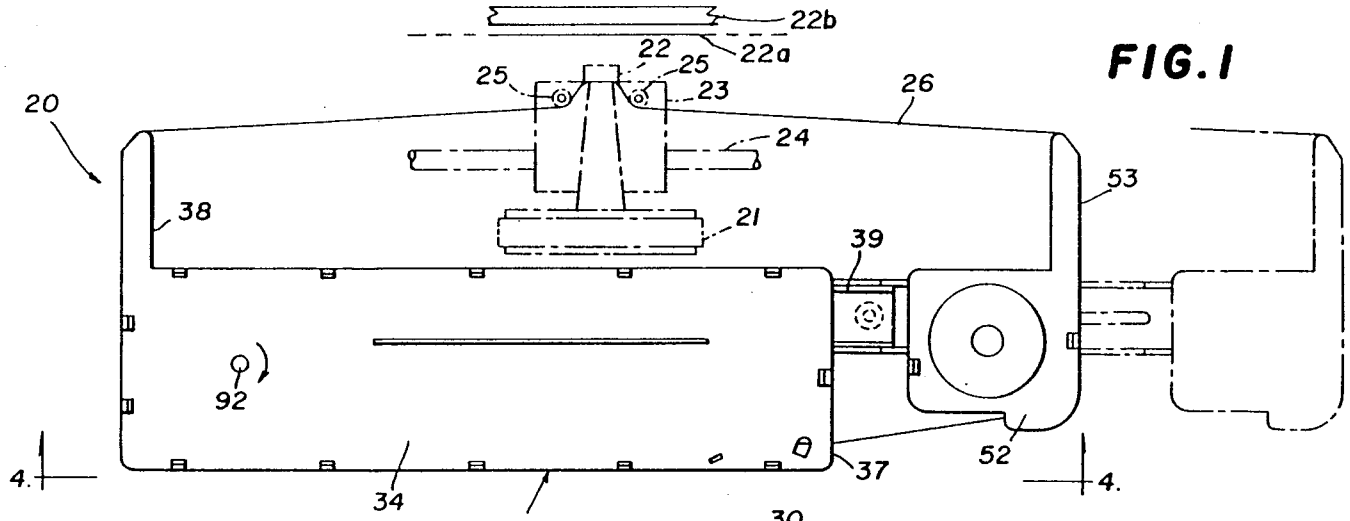
FIG. 1 is a top plan view of an inked ribbon cartridge incorporating the features of the present invention, the movable arm of the cartridge being shown in its contracted position in solid line and in its expanded position in phantom.

Turning now to the drawings and particularly to FIG. 1 thereof, there is depicted an inked ribbon cartridge 20 incorporating the features of the present invention. The cartridge 20 is utilized in a printer of which only a few of the elements thereof are depicted in FIG. 1. The printer includes a print head 21 which may be of the dot matrix print type. The head 21 has a plurality of wires, say seven, or a different number, which are selectively activated to produce different characters or patterns on a print medium. The wires operate against a print medium **22*a* backed by a platen or striker bar 22*b*. The head 21 is carried on frame structure 23 reciprocally movable on a rail 24. The frame structure 23 also includes a pair of upstanding guide rollers 25. The cartridge 20 contains a supply of inked ribbon 26 which is threaded around the rollers 25 and between the print head 21 and the medium 22*a*. The position of the cartridge 20 is fixed on the printer and the print head 21 is moved back and forth (right and left as viewed in FIG. 1) along the rail 24. The wires in the print head 21 are selectively actuated at each incremental position to strike the ribbon 26 and the medium 22*a* disposed between the ribbon and the platen or striker bar 22*b* to produce characters thereon. The travel of the print head 21, that is, the distance it traverses from side to side is different in different printers according to the width of the print medium for which the printer is designed for. It is advantageous that the length of exposed ribbon as depicted in FIG. 1 be generally the same as the travel of the print head 21. The cartridge has means to increase the length of such exposed ribbon, as represented by the phantom line in FIG. 1**. The structure giving rise to this capability will be described in further detail.

The cartridge 20 comprises an elongated, rectangular housing 30 for storing both the used and unused inked ribbon. The housing 30 includes a shallow case 31 having a rectangular bottom wall 32 and four upstanding side walls 33. A rectangular cover 34 has depending, integral U-shaped clips 35 that lockably engage bosses 36 on the side walls 33. At the front end of the housing 30 is an outlet port 37 through which the ribbon 26 exits the housing 30. At the rear end of the housing 30 is a laterally extending finger 38 which has a channel therein to accommodate the used ribbon 26 being returned to the housing 30.

Figure 2:
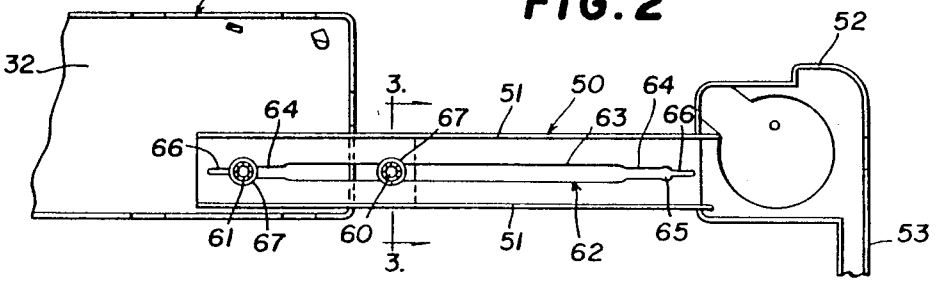
FIG. 2 is a fragmentary bottom view of the cartridge with the arm in its expanded position.
Figure 3:
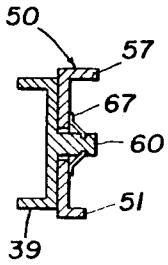
FIG. 3 is a sectional view on an enlarged scale taken along the line 3—3 of FIG. 2.

Protruding forwardly at the front end of the housing 30 is an extension 39. Referring also to FIGS. 2 and 3, the cartridge 20 comprises an arm 50 extending longitudinally forwardly from the housing 30, the arm 50 having side reinforcing flanges 51. At the front end of the arm 50 and integral therewith is a subhousing 52 for purposes to be described. The arm 50 carries a laterally extending finger 53 disposed generally parallel to the finger 38. The ribbon 26 exits the outlet port 37 of the housing 30 and through the the finger 53. The extension 39 carries a lug 60 and the housing 30 carries a lug 61, the lugs 60 and 61 being longitudinally spaced-apart and downwardly directed. The arm 50 has a longitudinally extending slot 62 most of which is a portion 63 having a width slightly greater than the diameter of the lugs 60 and 61. Each end of the slot 62 includes an outer portion 64 having a width slightly less than the diameter of each of the lugs 60 and 61, and an enlarged tip 65 of a size substantially the same as each such lug. Finally, the slot 62 terminates with slits 66. Push-on fasteners 67 retain the arm 50 on the lugs 60 and 61. The arm 50 is longitudinally slidably movable on the lugs 60 and 61, being freely movable when both lugs are located in the main portion 63. When it is desired to place the arm 50 in its contracted position, that is, when the fingers 38 and 53 are to be relatively close together, the arm 50 is pushed rearwardly with respect to the housing 30. The outer portion 64 on the forward end of the slot 62 spreads slightly by virtue of the flexibility created by the slit 66. Further rearward movement of the arm 50 causes the lug 60 to snap into the tip 65 at the forward end of the arm 50. On the other hand, when it is desired to place the arm 50 in its expanded position, that is, when the fingers 38 and 53 are to be farthest apart, the arm 50 is moved forwardly, whereby the lug 61 is caused to spread the portion 64 on the rear end of the arm 50 and to snap into the tip 65 on such end. Thus, the cartridge 20 is readily placed in either of two positions to enable it to be used in a printer which has a short print-head travel or a long print-head travel. The arm 50 is fairly secure in either position, particularly because the cartridge is lockably fitted into the printer. Of course, a similar structure would also enable having one or more intermediate positions of the arm 50.

Figure 5:
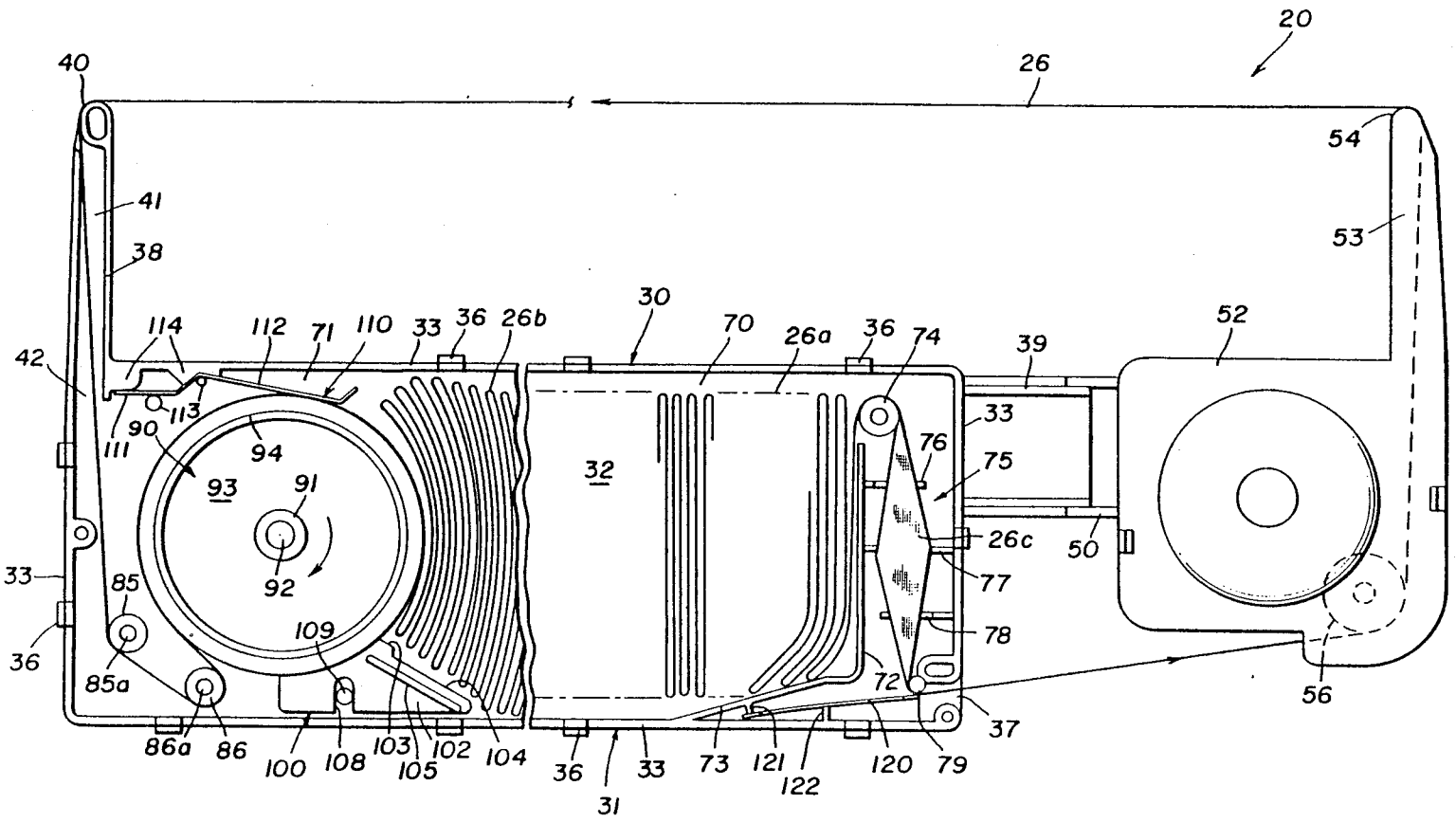
FIG. 5 is a top plan view of the cartridge with the cover removed.

Referring to FIG. 5, further details of the cartridge 20 will be described. The housing 30 has a forward section 70 in which a bulk supply 26*a* of folded ribbon is stored. The housing 30 also has a rear section 71 in which the drive wheel 90 and stripper mechanism 100 are located as will be described. At the forward end of the forward section 70 is a dam 72 against which the ribbon supply 26*a* is pushed. A ramp 73 guides the ribbon 26 slightly upwardly and forwardly. The ribbon 26 passes around an idler roller 74 to a ribbon inverting mechanism 75 which forms a mobius loop 26*c* to invert the ribbon and present first one side and then the other side of the ribbon to the medium for printing by the print head 21. The inverting mechanism 75 includes a wall 76 that has its upper surface inclined downwardly and forwardly, a wall 77 having a generally horizontal surface, and a wall 78 having its upper surface inclined downwardly and rearwardly. There are three mating walls on the cover 34. The ribbon 26 is located between the mating walls, thereby creating the mobius loop 26*c*. The ribbon 26 is routed around a support post 79 through the exit port 37 to an idler roller 56 located in the housing 52, then through the hollow finger 53 over a guide surface 54 across to the other finger 38. The ribbon 26 is directed by a guide surface 40 into a channel 41 in the finger 38 to the ribbon inlet 42 of the housing 30. The used ribbon passes around idler rollers 85 and 86 respectively carried by shafts 85*a* and 86*a* integral with and upstanding on the bottom wall 32.

Figure 4:
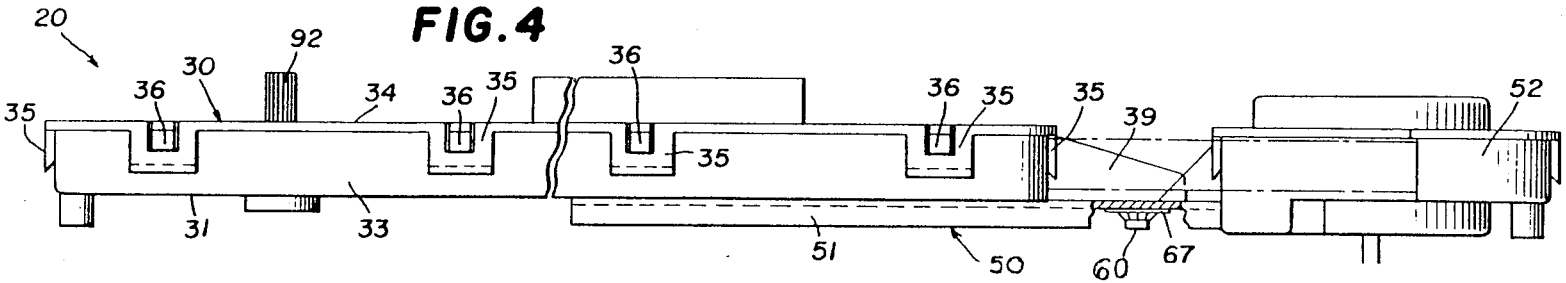
FIG. 4 is an enlarged, elevational view taken along the line 4—4 of FIG. 1.
Figure 8:
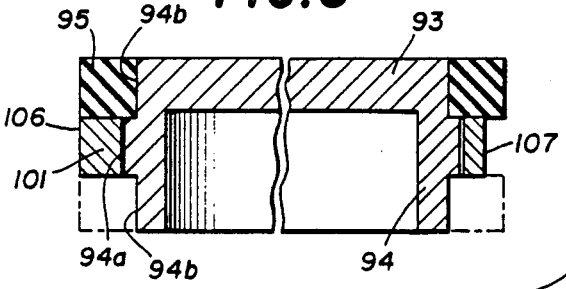
FIG. 8 is a fragmentary sectional view on an enlarged scale taken along the line 8—8 of FIG. 6.

The cartridge 20 includes a drive wheel 90 to which the ribbon 26 is applied. The drive wheel 90 includes a hub 91 from which extends a knob 92 that protrudes through the cover 34 (FIGS. 1 and 4) to enable rotation thereof by a user for manually tensioning the portion of ribbon between the fingers 38 and 53. The other end of the hub 91 is adapted to receive the shaft of a driving mechanism (not shown) which rotates the wheel 90 to move the ribbon in the manner to be described. The drive wheel 90 is cup shaped having a circular wall 93 that terminates in an annular rim 94. Referring also to FIG. 8, the rim 94 has a centrally located ledge defining a raised surface 94*a* and side surfaces 94*b* of lesser radius of curvature. Located on each of the surfaces 94*b* is an annular tread 95 which may be composed of elastomeric urethane. The coefficient of friction of the treads 95 is such that the ribbon 26 is gripped and driven by the tread 95 to the storage compartment.

Figure 6:
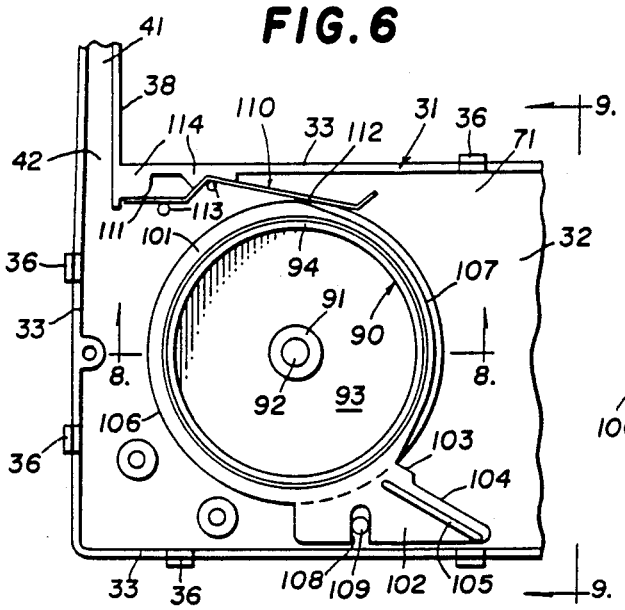
FIG. 6 is a view of the stripper and drive mechanism with one of the treads not shown.
Figure 7:
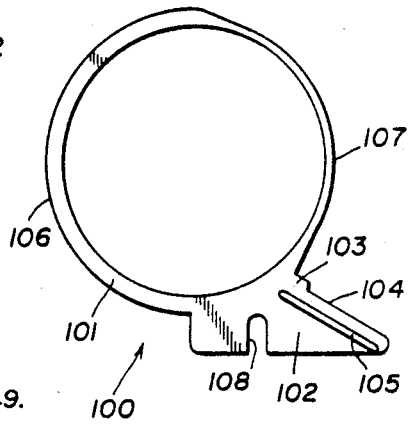
FIG. 7 depicts the stripper mechanism.

Referring also to FIGS. 6 and 7, the cartridge 20 further comprises a stripper mechanism 100 including an annular ring 101 carrying a foot 102. The foot 102 has a downwardly and forwardly inclined short shoulder 103. Offset from the shoulder 103 is a downwardly and forwardly extending stop surface 104. The width of the shoulder 103 and the surface 104 is substantially the same as the width of the ring 101. Offset downwardly from the surface 104 is a pair of laterally extending wings 105 each of which has a width about the same as the width of the surfaces 94*b*. The wings 105 are downwardly and forwardly inclined. The drive wheel 90 is located inside the ring 101 between the treads 95. The ring 101 is aligned with the surface 94*a* and has an inside diameter slightly greater than the radius of curvature of the surface 94*a* so that the drive wheel 90 can rotate unimpeded by the ring 101.

The ring 101 has an entry surface 106 and an exit surface 107. As can be seen in FIG. 8, the radius of curvature of the entry surface 106 is substantially the same as the radius of curvature of the outer surface of the treads 95, while the radius of curvature of the exit surface 107 is less than the radius of curvature of the tread outer surface. As can be seen in FIG. 5, after exiting the roller 86, the ribbon 26 contacts the treads 95 for an angular extent of about 260°, 140° of which the ribbon 26 is also in contact with the entry surface 106. For the remaining 120°, the exit surface 107 is recessed so that the ribbon contacts only the outer surfaces of the treads 95.

The foot 102 has a notch 108 which receives a pin 109 upstanding from and integral with the bottom wall 32, thereby precluding the stripper mechanism 100 from rotation. The drive wheel 90 is free to rotate as previously mentioned.

To hold the ribbon 26 against the drive wheel 90, there is provided a leaf spring 110 having an attachment portion 111 and a finger 112. The attachment portion 111 is held in place by means of lugs 113 and suitable undulations 114 in the adjacent side wall 33. The finger 112 is biased in a clockwise direction and therefore against the treads 95. The ribbon 26 passes between the finger 112 and the treads 95, thereby creating a capstan effect. As the wheel 90 is rotated in a clockwise direction as shown, unused ribbon is withdrawn from the supply 26*a*, through the exit port 37, through the fingers 53 and 38, around the rollers 85 and 86 and to the drive wheel 90. As will be described, the leaf springs 110 and 120 (to be described) keep that portion of the ribbon between the two in tension.

When the ribbon passes the leaf spring 110, it is no longer in tension but is held against the treads 95 because the ribbon-to-tread grip (coefficient of friction) is greater than the ribbon-to-ribbon grip. In one embodiment the ribbon-to-tread coefficient of friction was of the order of 0.6 and the ribbon-to-ribbon coefficient of friction was of the order of 0.4. Initially, the entire section 70 is filled with the supply 26*a* of unused ribbon. As the wheel 90 rotates, the ribbon exiting the leaf spring 110 is maintained in contact with the treads 95 for two reasons. First, the friction between the treads and the ribbon is greater than the ribbon-to-ribbon friction. Secondly, the ribbon 26 fills the entire space between the dam 72 and the wheel 90, therefore exerting rearward force on the ribbon against the drive wheel 90. As the wheel 90 rotates, a length of ribbon as measured by the distance between 110 and 103 will be metered out by the wheel 90 until the lower fold in that length strikes the shoulder 103, at which time the ribbon below the leaf spring 110 loses grip on the ribbon, but the ribbon at the leaf spring continues to be driven by the treads and a new upper fold is created. As the next length following that fold is created, the previous length is pushed forwardly and eventually off of the shoulder 103. In this manner the used ribbon is folded for storage.

The entry surface 106 of the stripper ring 101 being flushed with the outer surfaces of the treads 95 means that the ribbon 26 in its tension condition between the roller 86 and the leaf spring 110 is drawn tightly against all three surfaces. There is no recess created by the space occupied by the stripper ring 101 into which the ribbon could be pulled by virtue of the tension thereon to cause the ribbon to lose contact with the treads 95. On the other side of the wheel 90, the ribbon 26 is not in tension, but rather is being pushed. The exit surface 107 having a lesser radius of curvature than that of the treads 95 creates a recess so that the ribbon only contacts the treads to which it grips. Failure to grip would mean that the ribbon could drop off the treads 95 prematurely. Then instead of long lengths extending substantially between the side walls 33, short lengths would be created which would more likely create a jam in the cartridge 20.

The construction of the stripper mechanism 100 minimizes ribbon jams. In the past, tines projected into a slit in the drive wheel, and the ribbon had a tendency to get caught in the slit and/or the tines. The construction described has no slits, the foot 102 being integral with and an extension of the ring 101.

The shoulder 103 is short so as to accommodate only a few folds or so, the next ribbon length pushing such folds off of the shoulder 103. Those folds then float and, therefore, offer minimum resistance to being pushed forwardly by new lengths of ribbon being created by the drive wheel 90. The surface 104 defines a backup to stop occasional folds which may tend to droop. The wings 105 define a safety barrier against twisted folds from continuing to adhere to the treads 95 and getting caught to create a jam.

Figure 10:
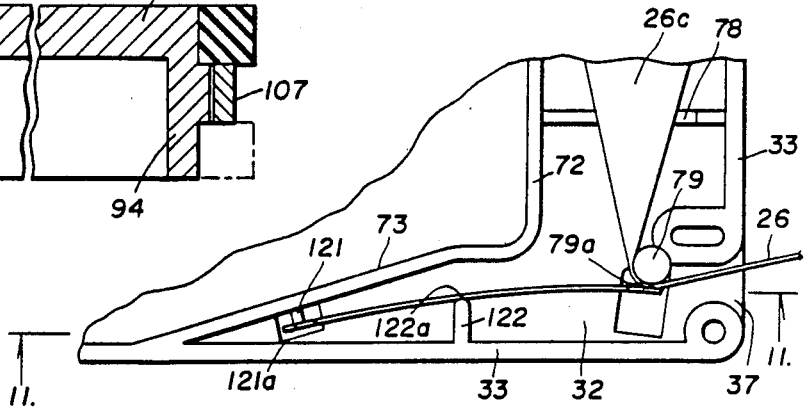
FIG. 10 is an enlarged view of that portion of the cartridge in FIG. 5 in the lower right-hand corner of the housing.
Figure 9:
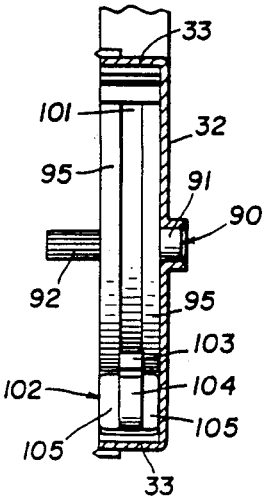
FIG. 9 is a view in vertical section taken along the line 9—9 of FIG. 6, but with both treads in place.
Figure 11:
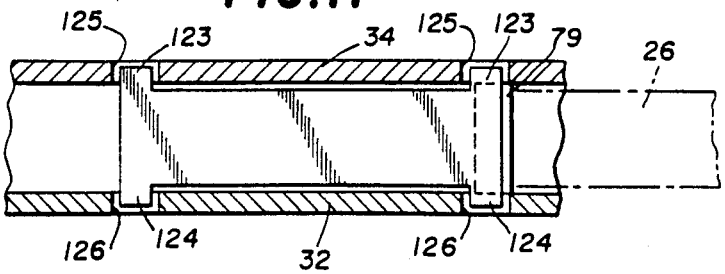
FIG. 11 is a view in vertical section taken along the line 11—11 of FIG. 10.

Referring to FIGS. 5, 10 and 11, details of the leaf spring 120 and its mounting will be described. A laterally extending lug 121 is provided on the ramp 73 and a laterally extending lug 122 is provided on one of the side walls 33. The lugs 121 and 122 respectively have supporting surfaces **121*a* and 122*a*, and the lug 79 has a supporting surface 79*a*. The leaf spring 120 is in contact with the supporting surfaces 79*a*, 121*a* and 122*a*. The supporting surface 122*a* is over center with respect to the supporting surfaces 79*a* and 121*a*, whereby the leaf spring 120 is biased against the lug 79 and the ribbon therebetween. In the past, the ribbon had a tendency to creep off the lug 79 and get caught above or below the leaf spring, thereby creating a ribbon jam. This is avoided by providing the leaf spring 120 at one end thereof with an upper tab 123 and a lower tab 124, causing the effective height of the spring to exceed the distance between the upper surface of the bottom wall 32 and the lower surface of the cover 34, thereby precluding the ribbon 26 from creeping over or under the leaf spring 120. Similar tabs 123 and 124 are provided at the other end of the leaf spring 120 so that the worker assembling the same does not have to exert care in orientation and to provide locating means for the spring. To accommodate the increased effective height of the leaf spring 120 at its ends, the cover has openings 125 and the bottom wall has openings 126**.

Figure 12:
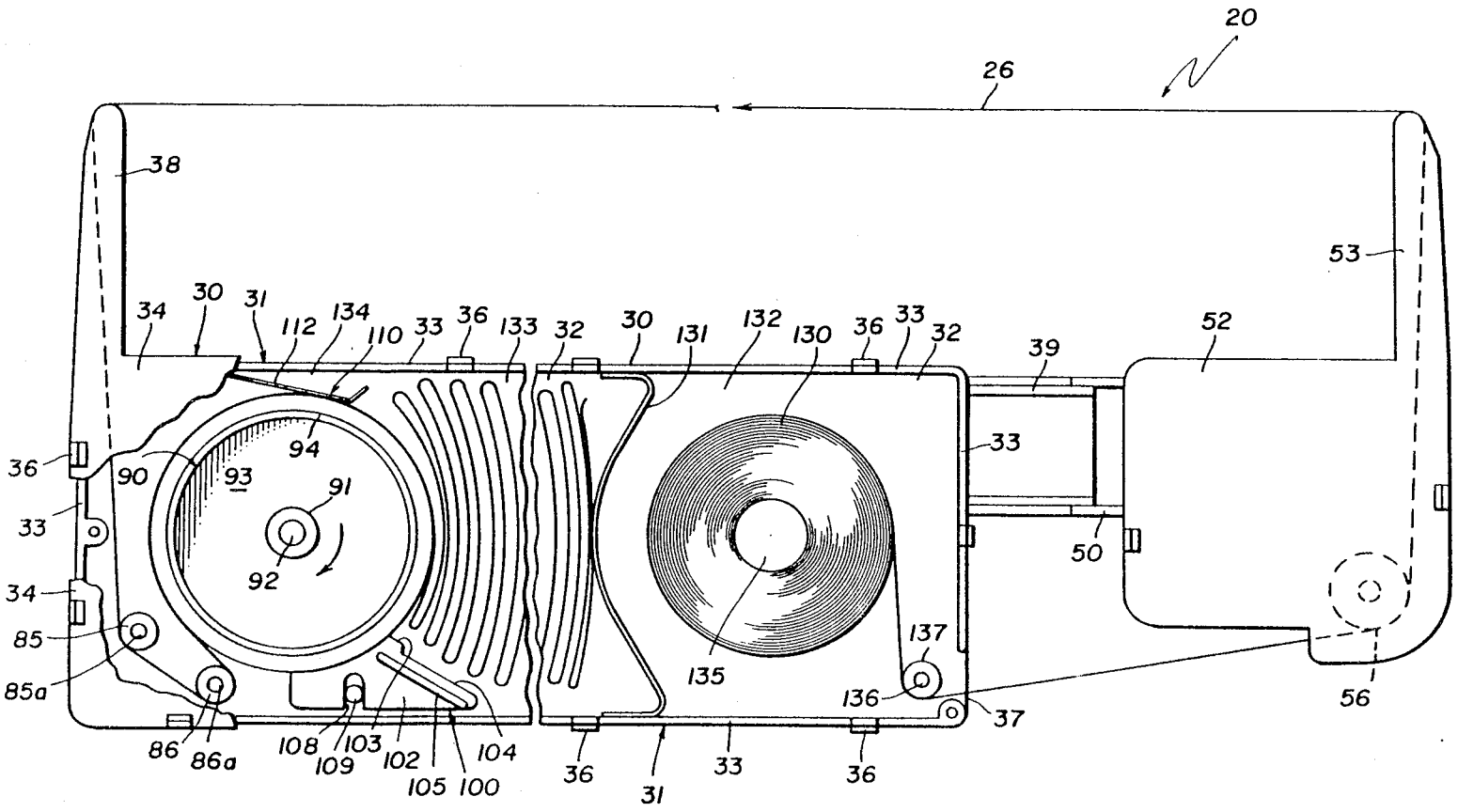
FIG. 12 is a view like FIG. 5 but with the unused ribbon being stored in roll form rather than folded form.

The cartridge 20 may accommodate ribbon in roll form rather than being folded as shown in FIGS. 1–11. The cartridge 20 is modified to accommodate a roll of ribbon 130 as depicted in FIG. 12. The mold for making the plastic housing 30 is modified so as not to produce the elements 72–79. Instead a dam 131 is added, to separate the interior of the housing 30 into a front section 132 and a middle section 133. The drive wheel and stripper mechanism are located in a third or rear section 134. The mold is further modified to cause an upstanding spindle 135 and an upstanding shaft 136 to be formed. The shaft 136 carries a roller 137. Ribbon from the roll 130 is wound around the roller 137, exiting through the port 37. From that point through the drive wheel 90 and the stripper mechanism 100, the form depicted in FIG. 12 is substantially the same as that depicted in FIGS. 1–11 in construction and operation. The used ribbon is stored in the section 133 operating against the dam 131, and once the roll is consumed the cartridge may be discarded.

What has been described, therefore, is an improved inked ribbon cartridge which is versatile enough to be usable in printers with different print-head stroke lengths, which can accommodate a supply of fresh ribbon in folded form or roll form, and which is designed to minimize the chances of the ribbon becoming jammed during use.

While the invention has been shown and described with reference to preferred embodiments thereof, it will be understood by those skilled in the art that various changes in form and details may be made therein without departing from the spirit and scope of the invention.

What I claim as new and desire to secure by Letters Patent of the United States is:

1. An inked ribbon cartridge for a printing device, said cartridge comprising:

a source of printing ribbon, an elongated housing for storing said printing ribbon;

said housing having an exit port at one end thereof through which said printing ribbon exits from said housing, a first finger extending laterally from an entrance port located at the other end of said housing, said first finger communicating with the interior of said housing for passing said printing ribbon from the exterior of said housing to said interior via said entrance port, an arm extending longitudinally from said one end of said housing and being longitudinally extendable therefrom, said arm carrying a laterally extending second finger spaced longitudinally from said first finger, said second finger passing the printing ribbon exiting from said exit port to said exterior, said ribbon being available for printing in the exterior region between said fingers, and means for maintaining said first and second fingers in a desired, fixedly aligned position to facilitate ribbon printing, said means including rigid transverse flanges on said arm which is permanently but slidably attached to an external lower surface of the housing at a side portion disposed nearest said first finger.

2. The inked ribbon cartridge of claim 1, wherein said elongated housing has first and second longitudinally adjacent sections, said first section being nearer said one end, unused ribbon being stored on a roll located in said first section, the unused ribbon exiting said housing through said port and the used ribbon entering said housing through said second finger, the used ribbon being stored in said second section.

3. The inked ribbon cartridge of claim 2, wherein said housing has a third section between the other end of said housing and said second section, a rotatable drive wheel in said third section and in operative contact with said used ribbon for withdrawing unused ribbon from said first section and for stuffing the used ribbon into said second section.

4. The inked ribbon cartridge of claim 1, comprising means for causing ribbon to be stored in said housing in folded form and to exit said housing through said port, the ribbon entering said housing through said second finger and being stored behind the ribbon previously stored in folded form.

5. The inked ribbon cartridge of claim 1, and further comprising means for retaining said arm at a selected longitudinal position with respect to said housing.

6. The inked ribbon cartridge of claim 1, wherein said arm has a longitudinally extending slot therein, said housing having a pair of longitudinally spaced-apart lugs slidably disposed in said slot, said lugs carrying means for retaining said arm on said housing while permitting longitudinal sliding movement with respect thereto.

7. A cartridge as in claim 1 further comprising:

means located within said housing proximate said first end for inverting ribbon 180 degrees about its longitudinal axis.

8. A cartridge as in claim 7 wherein said means for inverting comprises a ribbon guide structure for inverting ribbon about its longitudinal axis in three discrete stages.

9. An inked ribbon cartridge for a printing device, said cartridge comprising:

a source of ribbon, an elongated housing for storing said ribbon, said housing having a port at one end thereof through which said ribbon exits from said housing, a first finger extending laterally from the other end of said housing, said first finger communicating with the interior of said housing for passing said ribbon from the exterior of said housing to said interior, and an arm extending longitudinally from said one end of said housing and being longitudinally extendable therefrom, said arm carrying a laterally extending second finger spaced longitudinally from said first finger, said second finger passing the ribbon exiting from said port to said exterior, said ribbon being available for printing in the exterior region between said fingers, means for maintaining said first and second fingers in a desired aligned position to facilitate ribbon printing, said means including transverse flanges on said arm which is permanently but slidably attached to a lower surface of the housing at a side portion disposed nearest said first finger, wherein said arm has a longitudinally extending slot therein, said housing having a pair of longitudinally spaced-apart lugs slidably disposed in said slot, said lugs carrying means for retaining said arm on said housing while permitting longitudinal sliding movement with respect thereto; and wherein each end of said slot has an outer portion of a width slightly less than the diameter of each lug and a tip of a size substantially the same as each lug, the tip at one end snap fittingly receiving one of said lugs for one position of said arm, the tip at the other end snap fittingly receiving the other one of said lugs for another position of said arm.

10. A cartridge for printing ribbon for use in a printing device, said cartridge comprising:

an elongated housing for storing a supply of inked ribbon and having first and second laterally-extending opposite ends connected by first and second longitudinally extending opposite sides as well as bottom and top walls;

a ribbon exit port located at said first end proximate said second side and a ribbon entrance port located with and including a first laterally-extending finger portion at said second end which extends laterally outwardly beyond said first side;

first fastening means located on the bottom wall of the housing and proximate said first side; and a longitudinally extending arm which includes second fastening means mated to said first fastening means and permitting said arm to be slidably moved between predetermined positions along the exterior of said bottom wall of said housing while remaining firmly connected to said housing;

said arm including a subhousing at its distal end with a second laterally-extending finger portion extending laterally outwardly beyond said first side in the same direction as said first finger portion, said second finger portion also including a ribbon passage therethrough; and means for passing ribbon outwardly from said exit port through said subhousing and distal tip of the second finger portion, across a ribbon usage span to the distal tip of the first finger portion and into said entrance port.

11. A cartridge as in claim 10 wherein said arm includes transverse reinforcing side walls so as to include an L-shaped cross-section.

12. A cartridge as in claim 10 wherein said arm is affixed to move proximate said first side of the housing which is located nearest to the lateral extensions of the fingers.

13. A cartridge as in claim 10 wherein said exit port is located at said one end adjacent said second side and said subhousing having an entrance port located proximate said exit port, and means for passing ribbon from said exit port through said subhousing entrance port to said second finger.

14. A cartridge as in claim 10 further comprising a source of ribbon provided within said elongated housing.

15. A cartridge as in claim 10 wherein said bottom wall of said housing includes an extension located at said first end proximate to said first side and positioned in the direction of said subhousing, and said fastening means comprising a lug extending from said extension.

16. A cartridge for printing ribbon for use in a printing device, said cartridge comprising:

an elongated housing for storing a supply of inked ribbon and having first and second laterally-extending opposite ends connected by first and second longitudinally extending opposite sides as well as bottom and top walls;

a ribbon exit port located at said first end proximate said second side and a ribbon entrance port located with and including a first laterally-extending finger portion at said second end which extends laterally outwardly beyond said first side;

first fastening means located on the bottom wall of the housing and aligned proximate said first side;

a longitudinally extending arm which includes second fastening means mated to said first fastening means and permitting said arm to be slidably moved between predetermined positions along the bottom wall of said housing while remaining firmly connected to said housing;

said arm including a subhousing at its distal end with a second laterally-extending finger portion extending laterally outwardly beyond said first side in the same direction as said first finger portion, said second finger portion also including a ribbon passage therethrough; and means for passing ribbon outwardly from said exit port through said subhousing and a distal tip of the second finger portion, across a ribbon usage span to the distal tip of the first finger portion and into said entrance port;

said first fastening means including at least two lugs extending downwardly from said housing, parallel to said first side, and said second fastening means including an elongated slot permanently engaging said lugs therewithin and having a width which varies between a dimension that is slightly greater than, slightly less than and approximately equal to the dimensions of said lugs.

17. A cartridge as in claim 16 wherein said housing includes a longitudinal extension of its bottom wall upon which at least one of said lugs is affixed.

18. An inked ribbon cartridge for a printing device, said cartridge comprising:

a source of ribbon, an elongated housing for storing said ribbon, said housing having a port at one end thereof through which said ribbon exits from said housing, a first finger extending laterally from the other end of said housing, said first finger communicating with the interior of said housing for passing said ribbon from the exterior of said housing to said interior, an arm extending longitudinally from said one end of said housing and being longitudinally extendable therefrom, said arm carrying a laterally extending second finger in spaced apart relationship with respect to said finger, said second finger passing the ribbon exiting from said port to said exterior, said ribbon being available for printing in the region between said fingers and exterior of said cartridge, and means for selectively maintaining said first and second fingers in a plurality of desired fixedly aligned positions to facilitate printing with said ribbon between said positions, said arm including a reinforced structure which is permanently but slidably attached to an external lower surface of the housing at a side portion disposed nearest said printing positions.

19. A cartridge for printing ribbon for use in a printing device, said cartridge comprising:

an elongated housing for storing a supply of inked ribbon and having first and second laterally extending opposite end walls connected by first and second longitudinally extending opposite side walls as well as bottom and top walls;

a ribbon exit port located at said first end wall proximate said second side wall and a ribbon entrance port located with and including a first laterally-extending finger portion at said second end wall which extends laterally outwardly beyond said first side wall;

a longitudinally extending arm including a subhousing at its distal end with a second laterally-extending finger portion extending laterally outwardly beyond said first side wall in the same direction as said first finger portion, said second finger portion also including a ribbon passage therethrough;

means for selectively maintaining said first and second fingers in a plurality of desired aligned positions to facilitate printing between such positions;

means for passing ribbon outwardly from said exit port through said subhousing and a distal tip of the second finger portion, across a ribbon usage span to the distal tip of the first finger portion and into said entrance port; and first fastening means located on the bottom wall of the housing and proximate said first side;

said longitudinally extending arm includes second fastening means mated to said first fastening means and permitting said arm to be slidably moved between said desired positions along the exterior of said bottom wall of said housing while remaining firmly connected to said housing.

20. A cartridge as in claim 19 further comprising:

means for inverting ribbon 180 degrees about its longitudinal axis and located within said housing proximate and substantially parallel to said first end for feeding ribbon to said ribbon exit port.

* * * * *